US012318884B2

(12) United States Patent
Guo et al.

(10) Patent No.: US 12,318,884 B2
(45) Date of Patent: Jun. 3, 2025

(54) DOUBLE-SIDED POLISHING METHOD FOR OPTICAL LENS

(71) Applicants: DALIAN UNIVERSITY OF TECHNOLOGY, Liaoning (CN); DALIAN UNIVERSITY OF TECHNOLOGY NINGBO RESEARCH INSTITUTE, Zhejiang (CN)

(72) Inventors: Jiang Guo, Liaoning (CN); Bo Pan, Liaoning (CN); Pengfei Zhang, Liaoning (CN); Kangle Wang, Liaoning (CN)

(73) Assignees: DALIAN UNIVERSITY OF TECHNOLOGY, Liaoning (CN); DALIAN UNIVERSITY OF TECHNOLOGY NINGBO RESEARCH INSTITUTE, Zhejiang (CN)

( * ) Notice: Subject to any disclaimer, the term of this patent is extended or adjusted under 35 U.S.C. 154(b) by 16 days.

(21) Appl. No.: 18/007,539

(22) PCT Filed: Feb. 8, 2022

(86) PCT No.: PCT/CN2022/075429
§ 371 (c)(1),
(2) Date: Dec. 15, 2022

(87) PCT Pub. No.: WO2022/257489
PCT Pub. Date: Dec. 15, 2022

(65) Prior Publication Data

US 2024/0123567 A1 Apr. 18, 2024

(30) Foreign Application Priority Data

Jun. 8, 2021 (CN) ..... 202110638414.7

(51) Int. Cl.
*B24B 37/08* (2012.01)
*B24B 13/01* (2006.01)
*B24B 37/04* (2012.01)

(52) U.S. Cl.
CPC ..... *B24B 37/08* (2013.01); *B24B 13/01* (2013.01); *B24B 37/042* (2013.01)

(58) Field of Classification Search
CPC .... B24B 5/22; B24B 5/26; B24B 7/17; B24B 9/14; B24B 13/02; B24B 13/046;
(Continued)

(56) References Cited

U.S. PATENT DOCUMENTS 3,444,652 A * 5/1969 Blum ..... B24B 13/043 65/61
3,793,774 A * 2/1974 Kawaguchi ..... B24B 13/02 451/271
(Continued)

FOREIGN PATENT DOCUMENTS

CN 101804593 A 8/2010
CN 106312778 A 1/2017
(Continued)

OTHER PUBLICATIONS

Machine translation of DE-19800841-A1 (Year: 1999).*
Machine translation of JP-2002144205-A (Year: 2002).*

*Primary Examiner* — Robert F Neibaur
(74) *Attorney, Agent, or Firm* — MUNCY, GEISSLER, OLDS & LOWE, P.C.

(57) ABSTRACT

A double-sided polishing method for an optical lens belongs to the technical field of ultra-precision machining. In the double-sided polishing method, upper and lower surfaces of the lens are polished simultaneously by arranging abrasive tools on upper and lower positions of the lens, making the abrasive tools close to the upper and lower surfaces of the lens to swing back and forth in the polishing process,
(Continued)

producing relative motion and removing the surface materials. In the present invention, in order to eliminate a problem of removal ununiformity, a method for swing machining of abrasive tools and methods for turning over and polishing of workpieces are adopted in a polishing process, which can realize the high efficiency double-sided high-precision machining for a nonplanar lens, and the method can be applied to the double-sided polishing for different types of lenses.

5 Claims, 9 Drawing Sheets

(58) Field of Classification Search
CPC ..... B24B 13/00; B24B 13/01; B24B 13/0018; B24B 13/012; B24B 13/0012; B24B 37/08; B24B 37/022; B24B 41/053; B24B 47/16
USPC ..... 451/42, 171, 158, 159, 163, 262, 276, 451/277
See application file for complete search history.

(56) References Cited

U.S. PATENT DOCUMENTS

| | | | | |
|---|---|---|---|---|
| 5,024,024 | A * | 6/1991 | Watanabe | B24B 13/00 451/42 |
| 2012/0289127 | A1* | 11/2012 | Kojima | B24B 13/02 451/42 |

FOREIGN PATENT DOCUMENTS

| | | | | |
|---|---|---|---|---|
| CN | 106670896 | A | 5/2017 | |
| CN | 107877302 | A | 4/2018 | |
| CN | 209175450 | U | 7/2019 | |
| CN | 211414657 | U | 9/2020 | |
| CN | 113458909 | A | 10/2021 | |
| DE | 19800841 | A1 * | 7/1999 | B24B 13/0031 |
| DE | 102007050470 | A1 | 9/2008 | |
| GB | 901596 | A | 7/1962 | |
| JP | 2000296448 | A | 10/2000 | |
| JP | 2002144205 | A * | 5/2002 | |

* cited by examiner

DOUBLE-SIDED POLISHING METHOD FOR OPTICAL LENS

TECHNICAL FIELD

The present invention belongs to the technical field of ultra-precision machining, relates to a double-sided polishing device for an optical lens, and particularly relates to a high efficiency machining method for a spherical lens/aspherical lens.

BACKGROUND

In recent years, driven by a national major science and engineering project of laser fusion, a major science and technology project of high resolution earth observation and growing demands for various optical and mechanical products, the ultra-precision machining for optical components is developing towards the direction of high precision, high efficiency and low cost. Especially, with the rapid development of smart phones and digital electronic equipment industries, the precision demands for optical lens caused by improving the performance demands are higher and higher. As spherical/aspherical optical components of core parts of optical lenses, the accuracy thereof is often required to reach a nanometer/subnanometer level.

There are many polishing methods for optical components, such as chemical mechanical polishing, dissociating abrasive polishing, plasma polishing, ion beam polishing, etc. The dissociating abrasive polishing starts earlier and has been widely used in engineering field, because the parameters are easy to control and the performance is stable. Usually, in a traditional method, optical components with tens to hundreds of aperture will be made to be polishing abrasive tools which match the surface shape thereof, combining with dissociating abrasive polishing. But, in the traditional method, the single optical component must be turned in the polishing process in order to complete the complete machining for a single optical component. Because the polishing steps are cumbersome, the single optical components need to be turned over and over, which is usually labor-intensive and inefficient.

In order to improve the polishing efficiency of optical components, relevant exploration has also been carried out in the some researches, for example: The patent CN201822194991.8 discloses a double-sided lapping device for lenses and proposes a double-sided lapping system for lenses which can realize double-sided lapping for partial areas of lenses. The patent CN201710958602.1 discloses a double-sided polishing machine which has simple double sides and is applicable to irregular lenses, which realizes the double-sided polishing for irregular lenses by using a specific structure in combination with a small grinding head. The patent CN201610991703.4 discloses a double-sided device for magnetorheological finishing, which adapts to the double-sided lapping of plane or curved components of different diameters by changing the magnetic field action and the size and shape of an area, the size of magnetorheological conveyor belt, etc., in combination with a magnetorheological finishing method. But this method requires making magnetic boxes and working magnets of different shapes according to surface shapes of the lenses, and the implementation conditions are harsh and the costs are higher. To sum up, Most of the above-mentioned devices or methods tend to realize the double-sided polishing device or system, which does not reflect the relationship between abrasive tools and lenses and have limited effect on improving the polishing efficiency of optical components.

SUMMARY

Aiming at the problems of a complicated polishing method, a complicated polishing process and low polishing efficiency existing in the above-mentioned methods, the present invention provides a double-sided polishing method which can efficiently polish an optical lens. The method proposed in the present invention is simple, the polishing abrasive tools are arranged on both sides of the lenses respectively, and the surface shapes of the abrasive tools and the motion trajectory of the grinding head are controlled, which can realize the high efficiency ultra-precision machining for optical lenses.

In order to achieve the above-mentioned purpose, a technical solution adopted in the present invention is:

a double-sided polishing method for an optical lens, in the double-sided polishing method, upper and lower surfaces of the lens are polished simultaneously by arranging abrasive tools on upper and lower positions of the lens, making the abrasive tools close to the upper and lower surfaces of the lens to swing back and forth in the polishing process, producing relative motion and removing the surface materials. The double-sided polishing method for the optical lens specifically comprises the following steps, wherein the optical lenses comprise a biconvex lens, a biconcave lens and a concave convex lens:

step one: a lens to be polished with radius of curvature greater than 514.92 mm is selected, and the lens to be polished is placed in the middle of the upper and lower abrasive tools. The ends of the upper and lower abrasive tools away from the lens are respectively connected with universal joints and the universal joint is connected with a rod of pendulum;

step two: the position is adjusted to ensure that the upper and lower surfaces of the lens are bonded to or in contact with inner surfaces of the upper and lower abrasive tools, the loading pressure on the upper and lower abrasive tools of the lens are adjusted, the lens is pressed tightly, and swing machining is conducted;

step three: a certain speed of the upper and lower abrasive tools of the lens is set, and at the same time, the upper and lower surfaces of the lens are polished: the motion of the abrasive tools in the polishing process comprises the rotation of the upper and lower abrasive tools and the overall reciprocating swing of the upper and lower abrasive tools, wherein the rotation of the upper and lower abrasive tools is driven by a motor, and the upper and lower rods of pendulum drive the upper and lower abrasive tools to swing in an opposite direction through the universal joint (thus completing the circular trajectory swing relative to the lens to be polished). In the polishing process, the rate of material removal in a middle part of the abrasive tools is lower than that in the edge, and the upper and lower rods of pendulum drive the upper and lower abrasive tools of the lens to swing, which can increase the material removal uniformity. In addition, during the polishing process, the polishing fluid is supplied in a manner of center-inlet supply or external drip of the abrasive tools;

step four: in order to reduce the material removal ununiformity of the upper and lower surfaces of the lens caused by different rotational speeds of the upper and lower abrasive tools, the lens can be turned over and machined, or the rotational speeds of the upper and lower abrasive tools can be adjusted under the condition of the same radius of curvature of the upper and lower surfaces; and step five: the above-mentioned process is carried out until the polishing process is completed.

Further, according to different surface shapes, the lens is divided into a biconvex lens, a biconcave lens and a concave convex lens. On this basis, the lens can be divided into a spherical lens and an aspherical lens according to the characteristics of surface curvature of the lens. For the spherical and aspherical lenses with diameters of 50 to 300 mm, in the double-sided polishing method, the polishing abrasive tools that are suitable for the surface shape characteristics of the lens to be polished is provided: wherein, the aspherical lenses can only be polished by using the spherical grinding head abrasive tool 10 and a planar disc abrasive tool 18; according to the characteristics of the surface shape, the spherical lens can be polished by using an arc disc abrasive tool 7, the spherical grinding head abrasive tool 10 and the planar disc abrasive tool 18, and upper and lower covering type abrasive tools (upper and lower covering type refers to the upper and lower abrasive tools can wrap the lens) respectively, for example, biconvex spherical lens 6, concave convex spherical lens 14, and biconcave spherical lens 17, the abrasive tool can completely fit the upper and lower surfaces of the lens, such as the upper and lower covering type abrasive tools 4, 5, 12, 13, 16 and 17 of the whole removal material on the surface of the lens, and at the same time, the arc disc abrasive tool 7, the spherical grinding head abrasive tool 10 and the planar disc abrasive tool 18 can be used in combination.

A double-sided polishing method for a biconvex lens, the contact between the abrasive tool used in the polishing process and the lens surface can be divided into a point contact or a surface point. The point contact type of abrasive tool (such as spherical grinding head abrasive tool 10 and planar disc abrasive tool 18) can be used only when the lens surface is aspherical, and the point contact type of abrasive tool or the surface contact type of abrasive tool can be used when the lens surface is spherical, comprising the following steps:

step one: a biconvex spherical lens 6 to be polished with radius of curvature greater than 514.92 mm is selected, and the biconvex spherical lens 6 to be polished is placed in the middle of the upper and lower abrasive tools 4, 5 of the biconvex spherical lens;

step two: the position is adjusted to ensure that the upper and lower surfaces of the biconvex spherical lens 6 are bonded to inner surfaces of two abrasive tools 7 of the biconvex spherical lens, the loading pressure on the upper and lower abrasive tools 4, 5 of the biconvex spherical lens are adjusted, the biconvex spherical lens 6 is pressed tightly, and the distance between the center of the abrasive tool and the center of the lens is set as ⅓ of an aperture of the lens in the process of swing machining;

step three: the rotational speed of the upper abrasive tool 4 of the biconvex spherical lens is set as 8 rpm, the rotational speed of the lower abrasive tool 5 of the biconvex spherical lens is set as 30 rpm, the upper and lower rods of pendulum 1, 3 drive the upper and lower abrasive tools 4, 5 of the biconvex spherical lens to swing in an opposite direction through the universal joints 2, and the polishing time is usually set as 5 min, and at the same time, the upper and lower surfaces of the biconvex spherical lens 6 are polished;

step four: in the polishing process, the rate of material removal in a middle part of the lens is lower than that in the edge of the lens, and the upper and lower rods of pendulum 1, 3 drive the upper and lower abrasive tools 4, 5 of the biconvex spherical lens to swing, which can increase material removal uniformity. In order to reduce the material removal ununiformity of the upper and lower surfaces of the biconvex spherical lens 6 caused by different rotational speeds of the upper and lower abrasive tools 4, 5 of the biconvex spherical lens, under the condition of the same radius of curvature of the upper and lower surfaces, the biconvex spherical lens 6 can be turned over and machined, and when the number of times of turning over and machining reaches 6, the upper and lower surface can achieve uniformity requirements. In addition, the rotational speeds of the upper and lower abrasive tools 4, 5 of the biconvex spherical lens are adjusted reversely: the rotational speed of the upper abrasive tool 4 of the biconvex spherical lens is set as 30 rpm and the rotational speed of the lower abrasive tool 5 of the biconvex spherical lens is set as 8 rpm. The polishing time is set as 5 min, and the material removal uniformity of the upper and lower surfaces of the biconvex spherical lens 6 is improved; and step five: the above-mentioned process is carried out until the polishing process is completed.

A double-sided polishing method for a concave convex lens, the contacts between the abrasive tool used in the polishing process and the lens surface can be divided into a point contact and a surface point. The point contact type of abrasive tool (such as spherical grinding head abrasive tool 10) can be used only when the lens concave is aspherical, and the point contact type of abrasive tool or the surface contact type of abrasive tool can be used when the lens concave is spherical, comprising the following steps: comprising the following steps:

step one: firstly, the concave convex lens 14 to be polished with radius of curvature of the concave greater than that of the convex is concentrically mounted in a circular retaining ring 8. The interference fit between an outer ring of the retaining ring 8 and an inner ring of a bearing 9 is conducted to ensure rotation of the retaining ring 8 and the concave convex lens 14 relative to the inner ring of the bearing 9. Then, the concave convex lens 14 to be polished is placed in the middle of the upper and lower abrasive tools;

step two: the position is adjusted to ensure that the upper and lower surfaces of the concave convex lens 14 are connected with or in point contact with the inner surfaces of the upper and lower abrasive tools, the contact pressure on the upper and lower abrasive tools of the concave convex lens are adjusted, the contact pressure is kept constant in the process of swing machining, and the whole surface of the lens is polished and swept in a form of surface contact or point contact, wherein, in order to ensure a certain material removal rate and uniformity in the process of point contact machining, an angle between an axis of the abrasive tool and a tangent line of a contact point of the lens is 25° in the process of machining;

step three: the rotational speed of the upper abrasive tool is set as 8 rpm, and the rotational speed of the lower abrasive tool is set as 30 rpm. The upper and lower rods of pendulum 1, 3 drive the upper and lower abrasive tools of the biconcave lens to swing in an opposite direction through universal joints 2. The polishing time is usually set as 5 min, and at the same time, the upper and lower surfaces of the concave convex lens 14 are polished;

step four: in the polishing process, the rate of material removal in a middle part of the lens is lower than that in the edge of the lens, and the upper and lower rods of pendulum 1, 3 drive the upper and lower abrasive tools to swing, which can increase material removal uniformity. In order to reduce the material removal ununiformity of the upper and lower surfaces of the concave convex lens 14 caused by different rotational speeds of the upper and lower abrasive tools, the rotational speeds of the upper and lower abrasive tools 12, 13 of the concave convex spherical lens are adjusted reversely. The rotational speed of the upper abrasive tool 12 of the concave convex spherical lens is set as 30 rpm, and the rotational speed of the lower abrasive tool 13 of the concave convex spherical lens is set as 8 rpm. The polishing time is set as 5 min, and the material removal uniformity of the upper and lower surfaces of the concave convex lens 14 is improved; and step five: the above-mentioned process is carried out until the polishing process is completed.

A double-sided polishing method for a biconcave lens, the contacts between the abrasive tool used in the polishing process and the lens surface can be divided into a point contact and a surface point. The point contact type of abrasive tool (such as spherical grinding head abrasive tool 10) can be used only when the lens concave is aspherical, and the point contact type of abrasive tool or the surface contact type of abrasive tool can be used when the lens concave is spherical, comprising the following steps:

step one: firstly, the biconcave lens 17 to be polished with a certain radius of curvature is concentrically mounted in a circular retaining ring 8. The interference fit between an outer ring of the retaining ring 8 and an inner ring of a bearing 9 is conducted to ensure rotation of the retaining ring 8 and the biconcave lens 17 relative to the inner ring of the bearing 9. Then, the biconcave lens 17 to be polished is placed in the middle of the upper and lower abrasive tools;

step two: the position is adjusted to ensure that the upper and lower surfaces of the biconcave lens 17 are bonded to the inner surfaces of the upper and lower abrasive tools, the contact pressure on the upper and lower abrasive tools of the biconcave lens are adjusted, the contact pressure is kept constant in the process of swing machining, and the whole surface of the lens is polished and swept in a form of surface contact or point contact, wherein, in order to ensure a certain material removal rate and uniformity in the process of point contact machining, an angle between an axis of the abrasive tool and a tangent line of a contact point of the lens is 25° in the process of machining;

step three: the rotational speed of the upper abrasive tool is set as 8 rpm, and the rotational speed of the lower abrasive tool is set as 30 rpm. The upper and lower rods of pendulum 1, 3 drive the upper and lower abrasive tools of the biconcave lens to swing in an opposite direction through the universal joints 2. The polishing time is usually set as 5 min, and at the same time, the upper and lower surfaces of the biconcave lens 17 are polished;

step four: in the polishing process, the rate of material removal in a middle part of the lens is lower than that in the edge of the lens, and the upper and lower rods of pendulum 1, 3 drive the upper and lower abrasive tools to swing, which can increase material removal uniformity. In order to reduce the material removal ununiformity of the upper and lower surfaces of the biconcave lens 17 caused by different rotational speeds of the upper and lower abrasive tools, under the condition of the same radius of curvature of the upper and lower surfaces, the biconcave lens 17 can be turned over and processed, and when the number of times of turning over and machining reaches 6, the upper and lower surface can achieve uniformity requirements and step five: the above-mentioned process is carried out until the polishing process is completed.

Further, when the lens is in surface contact with the inner surface of the upper and lower abrasive tools, a polishing pad is arranged on the inner surface of the upper and lower abrasive tools, and is in direct contact with the lens surface during the polishing process.

The present invention has the beneficial effects: in view of the low polishing and machining efficiency of the upper and lower surfaces of the non-planar lens, in the present invention, the upper and lower surfaces of the lens are fit using upper and lower polishing abrasive tools, and at the same time, the polishing is conducted; and at the same time in order to eliminate a problem of removal ununiformity, methods for swing machining of abrasive tools and turning over and polishing of workpieces are adopted in a polishing process, which can realize the high efficiency double-sided high-precision machining for a nonplanar lens, and the method can be applied to the double-sided polishing for different types of lenses.

DESCRIPTION OF DRAWINGS

FIG. 1 (*b*) is a schematic view 2 of a polishing spherical lens process;

In the figures: 1 Upper rod of pendulum; 2 Universal joint; 3 Lower rod of pendulum; 4 Upper abrasive tool of biconvex spherical lens; 5 Lower abrasive tool of biconvex spherical lens; 6 Biconvex spherical lens 7 Arc disc abrasive tool; 8 Retaining ring; 9 Bearing; 10 Spherical grinding head abrasive tool; 11 Biconvex aspherical lens; 12 Upper abrasive tool of concave convex spherical lens; 13 Lower abrasive tool of concave convex spherical lens; 14 Concave convex aspherical lens; 15 Upper abrasive tool of biconcave spherical lens; 16 Lower abrasive tool of biconcave spherical lens; 17 Biconcave spherical lens; 18 Planar disc abrasive tool; 19 Concave convex aspherical lens; 20 Biconcave aspherical lens;

DETAILED DESCRIPTION

The present invention is further described below in combination with the drawings. In order to improve the polishing efficiency of an optical lens, the present invention proposes a double-sided polishing method for an optical lens by combining with the advantages and disadvantages of the existing polishing technology. Embodiments of the present invention are described below in combination with drawings.

a double-sided polishing method for an optical lens, in the double-sided polishing method, upper and lower surfaces of the lens are polished simultaneously by arranging abrasive tools on upper and lower positions of the lens, making the abrasive tools close to the upper and lower surfaces of the lens to swing back and forth in the polishing process, producing relative motion and removing the surface materials. The abrasive tools an upper abrasive tool and a lower abrasive tool respectively connected with a motor. The lens to be polished is in the middle of the upper abrasive tool and the lower abrasive. The upper and lower abrasive tools are respectively bonded to the upper and lower surfaces of the lens to be polished, and the ends of the upper and lower abrasive tools away from the lens are respectively connected with the upper and lower universal joints 2, and the universal joints 2 are connected with the upper and lower rods of pendulum 1, 3. The motion of the abrasive tools in the polishing process comprises the rotation of the upper and lower abrasive tools and the overall reciprocating swing of the upper and lower abrasive tools, wherein the rotation of the upper and lower abrasive tools is driven by the motor, and the rod of pendulum drives the upper and lower abrasive tools to complete the circular trajectory swing relative to the lens to be polished through the universal joint. In addition, during the polishing process, the polishing fluid is supplied in a manner of center-inlet supply or external drip of the abrasive tools;

Embodiment 1

Figure 1:
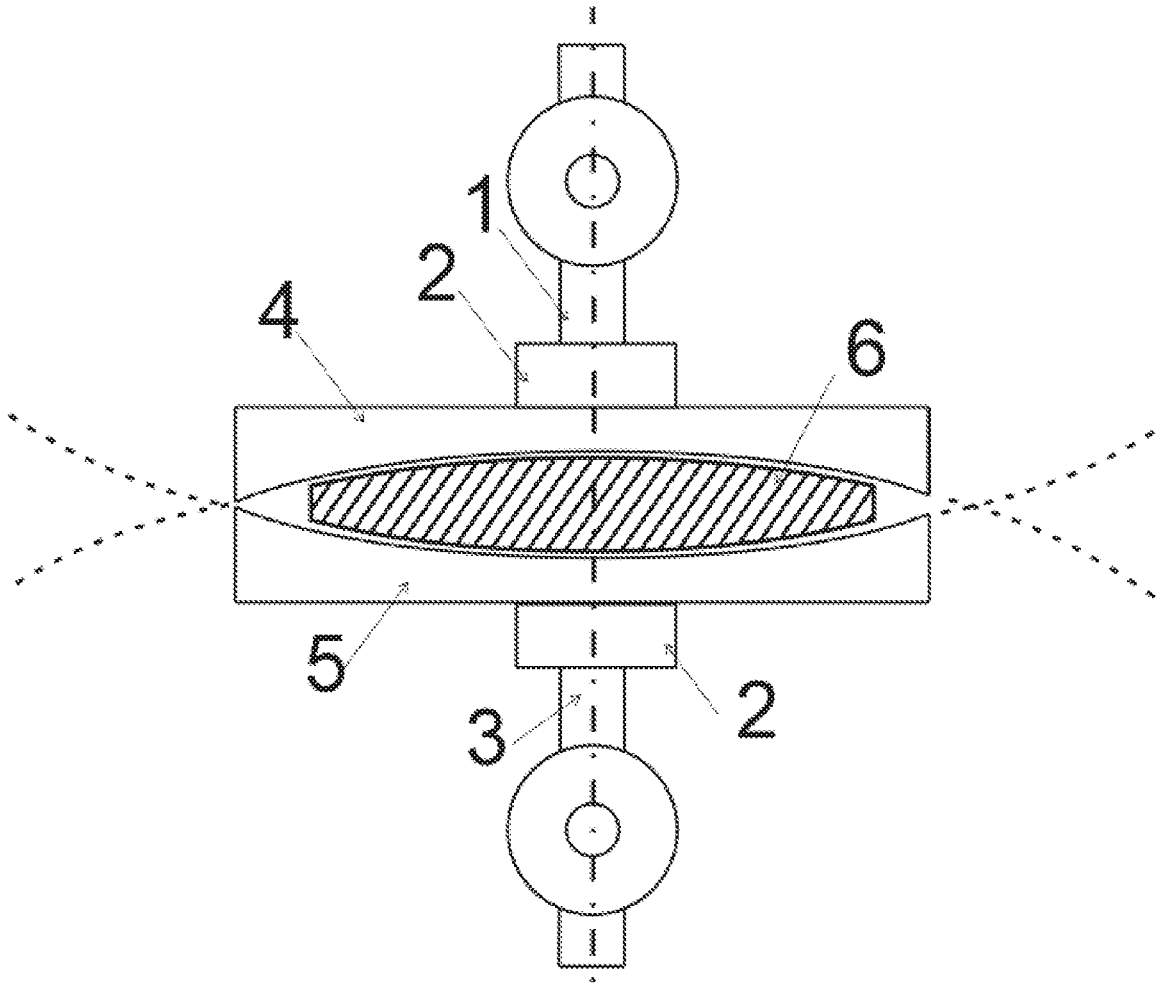
FIG. 1 (*a*) is a schematic view 1 of a polishing spherical lens process.
Figure 1:
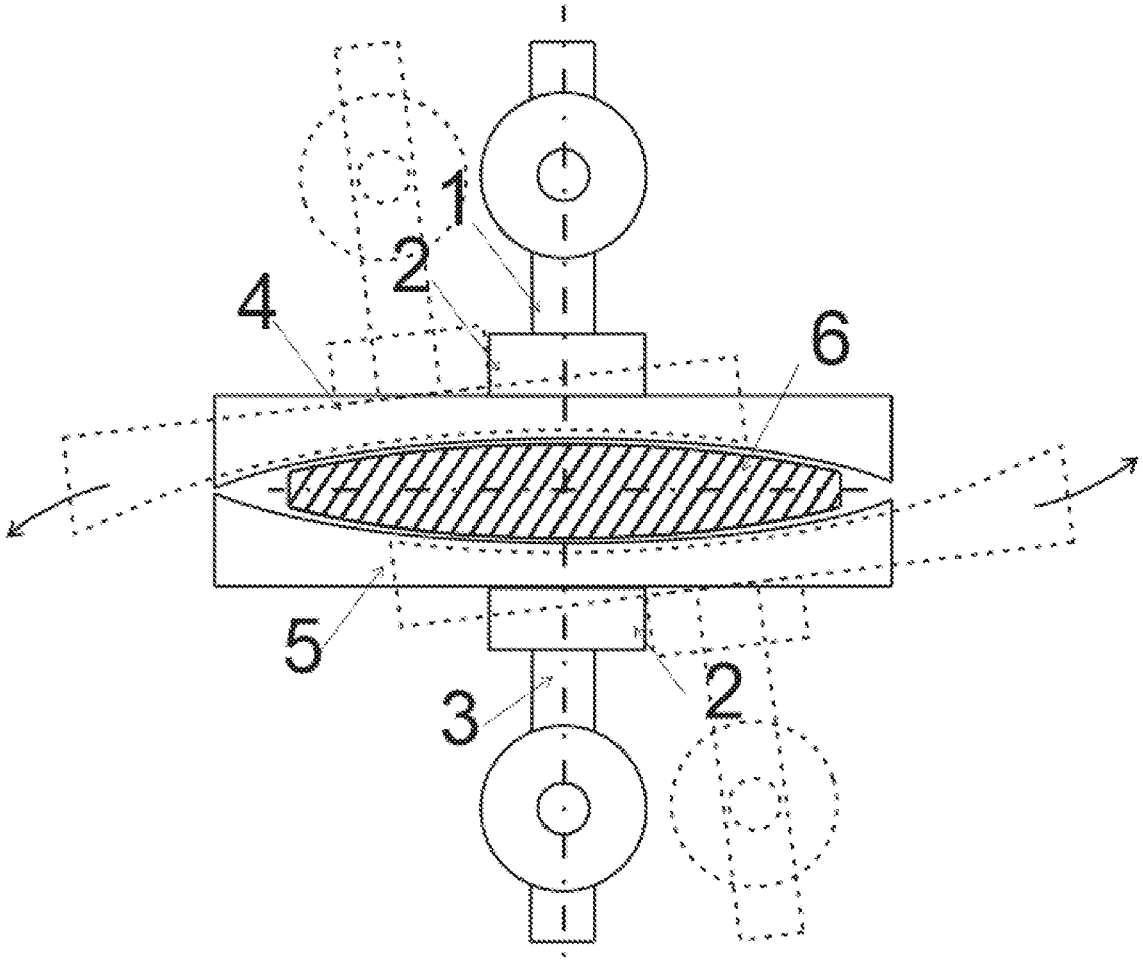

A polishing process for a spherical lens is shown in FIG. 1. For a biconvex spherical lens 6, double-sided polishing is conducted by adopting upper and lower abrasive tools 4, 5 of the biconvex spherical lens. The biconvex spherical lens 6 is placed directly in the middle of the upper and lower abrasive tools 4, 5 of the biconvex spherical lens.

The position is adjusted to ensure that the upper and lower surfaces of the biconvex spherical lens 6 are bonded to the inner surfaces of the upper and lower abrasive tools 4, 5 of the biconvex spherical lens. Then, by rotating the upper and lower abrasive tools 4, 5 of the biconvex spherical lens, the surface material of the lens is continuously removed to achieve the double-sided polishing of the biconvex spherical lens 6.

Figure 2:
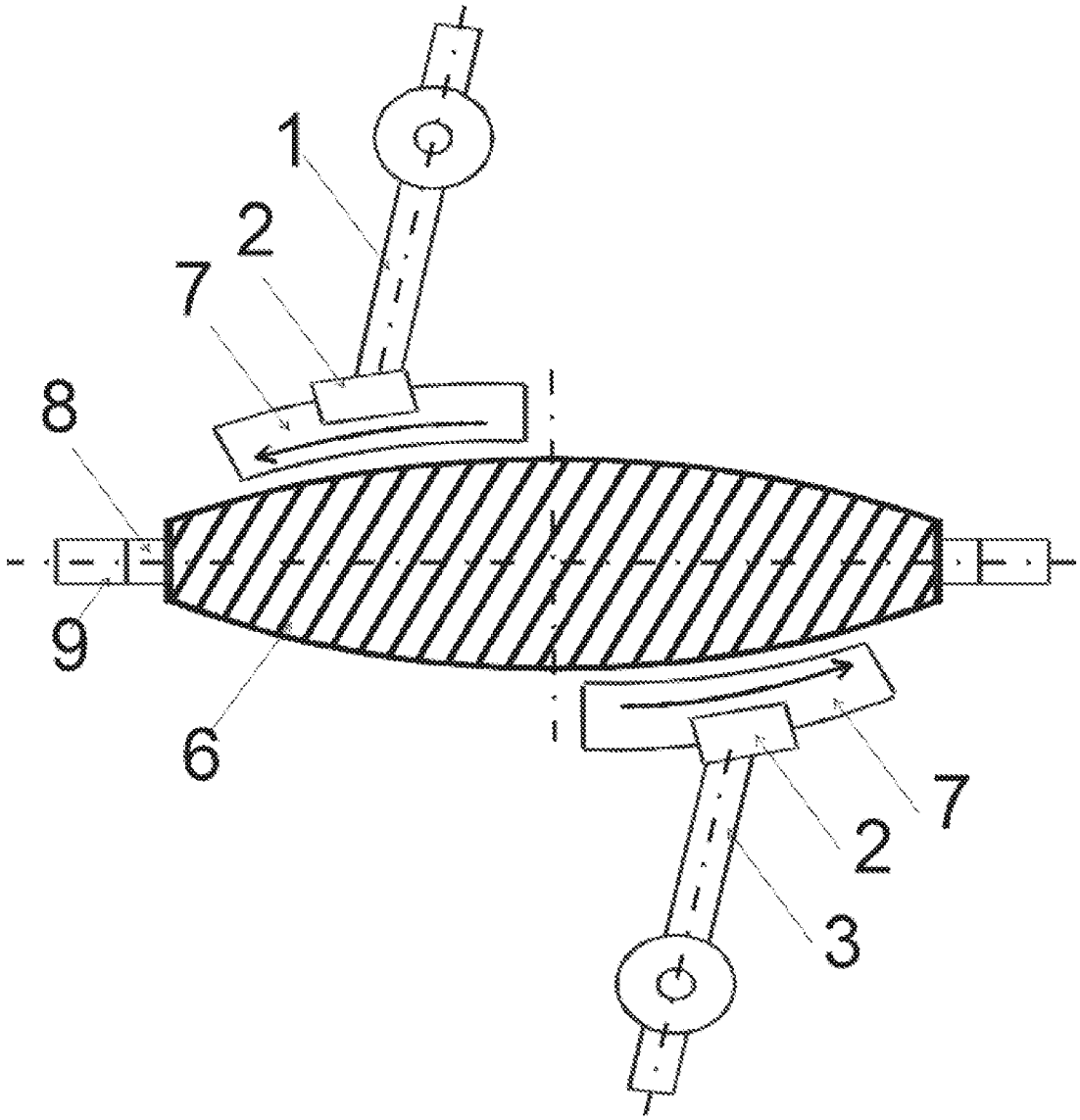
FIG. 2 is a schematic view of a polishing biconvex spherical lens.
Figure 3:
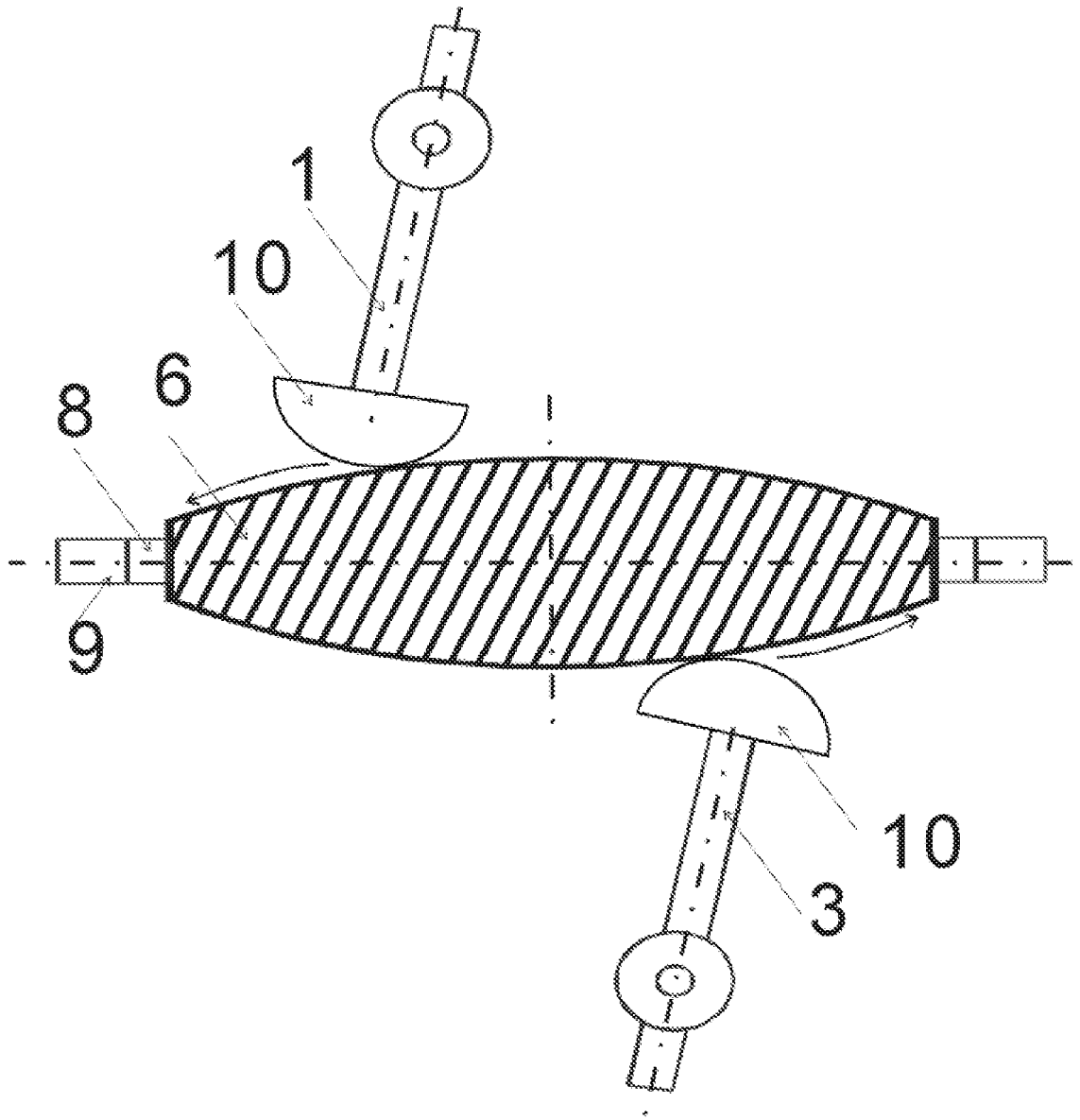
FIG. 3 is a schematic view of a polishing biconvex aspherical lens.

As shown in FIGS. 2 and 3, when the upper and lower abrasive tools adopt the arc disc abrasive tool 7 or the spherical grinding head abrasive tool 10, the biconvex spherical lens 6 needs to be concentrically mounted in a circular retaining ring 8. The interference fit between the retaining ring 8 and an inner ring of a bearing 9 is conducted, which ensures rotation of the retaining ring 8 and the biconvex spherical lens 6 relative to the inner ring of the bearing 9. The motion in the polishing process comprises the rotation of upper and lower abrasive tools 4, 5 of the biconvex spherical lens and the rotation that the upper and lower rods of pendulum 1, 3 drive the upper and lower abrasive tools 4, 5 of the biconvex spherical lens through the universal joints 2, wherein the rotation of the upper and lower abrasive tools 4, 5 of the biconvex spherical lens is driven by the motor, and the universal joints 2 are connected with ends of the upper and lower abrasive tools 4, 5 of the biconvex spherical lens, to complete the circular trajectory swing of the upper and lower abrasive tools 4, 5 of the biconvex spherical lens relative to the biconvex spherical lens 6.

In order to prevent the motion process interference of the upper and lower polishing abrasive tools 4, 5, the upper and lower abrasive tools 4, 5 of the biconvex spherical lens swing in an opposite direction in the polishing process. At the same time, there are certain requirement on the radius of curvature of the biconvex spherical lens to be machined. The radius of curvature of the upper and lower surfaces of the lens needs to be greater than 514.92 mm, wherein a polishing pad is arranged on the inner surfaces of the upper and lower abrasive tools 4, 5 of the biconvex spherical lens, and is in direct contact with the lens surface during the polishing process. The polishing fluid is supplied in a manner of center-inlet supply or external drip of the abrasive tools.

Figure 6:
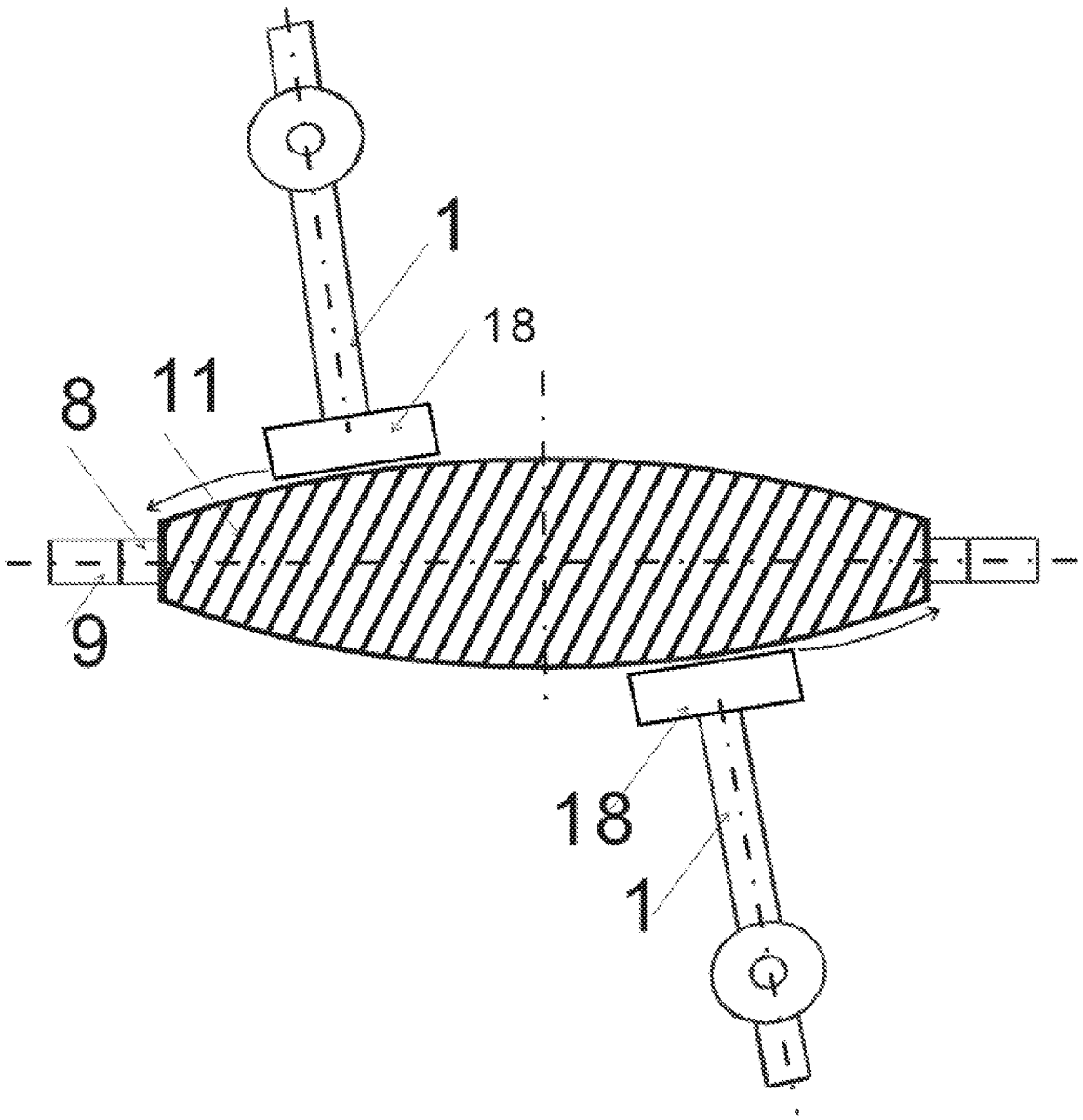
FIG. 6 is a schematic view of a polishing biconvex aspherical lens of small combined abrasive tools.

As shown in FIG. 6, for the biconvex aspherical lens 11, the double-sided polishing can be also conducted by adopting the planar disc abrasive tool 18. In addition, the biconvex aspherical lens 11 can be also polished by using the spherical grinding head abrasive tool 10.

For the double-sided polishing method for the biconvex spherical lens, the detailed steps are described as follows:

step one: a biconvex spherical lens 6 to be polished with radius of curvature greater than 514.92 mm is selected, and the biconvex spherical lens 6 to be polished is placed in the middle of the upper and lower abrasive tools 4, 5 of the biconvex spherical lens;

step two: the position is adjusted to ensure that the upper and lower surfaces of the biconvex spherical lens 6 are bonded to inner surfaces of two abrasive tools 7 of the biconvex spherical lens, the loading pressure on the upper and lower abrasive tools 4, 5 of the biconvex spherical lens are adjusted, the biconvex spherical lens 6 is pressed tightly, and the distance between the center of the abrasive tool and the center of the lens is set as ⅓ of the aperture of the lens in the process of swing machining;

step three: the rotational speed of the upper abrasive tool 4 of the biconvex spherical lens is set as 8 rpm, the rotational speed of the lower abrasive tool 5 of the biconvex spherical lens is set as 30 rpm, the upper and lower rods of pendulum 1, 3 drive the upper and lower abrasive tools 4, 5 of the biconvex spherical lens to swing in an opposite direction through the universal joints 2, and the polishing time is usually set as 5 min, and at the same time, the upper and lower surfaces of the biconvex spherical lens 6 are polished;

step four: in the polishing process, the rate of material removal in a middle part of the lens is lower than that in the edge of the lens, and the upper and lower rods of pendulum 1, 3 drive the upper and lower abrasive tools 4, 5 of the biconvex spherical lens to swing, which can increase material removal uniformity; and in order to reduce the material removal ununiformity of the upper and lower surfaces of the biconvex spherical lens 6 caused by different rotational speeds of the upper and lower abrasive tools 4, 5 of the biconvex spherical lens, under the condition of the same radius of curvature of the upper and lower surfaces, the biconvex spherical lens 6 can be turned over and machined, and when the number of times of turning over and machining reaches 6, the upper and lower surface can achieve uniformity requirements; and the rotational speeds of the upper and lower abrasive tools 4, 5 of the biconvex spherical lens are adjusted reversely: the rotational speed of the upper abrasive tool 4 of the biconvex spherical lens is set as 30 rpm and the rotational speed of the lower abrasive tool 5 of the biconvex spherical lens is set as 8 rpm. The polishing time is set as 5 min, and the material removal uniformity of the upper and lower surfaces of the biconvex spherical lens 6 is improved; and step five: the above-mentioned process is carried out until the polishing process is completed.

Embodiment 2

Figure 4:
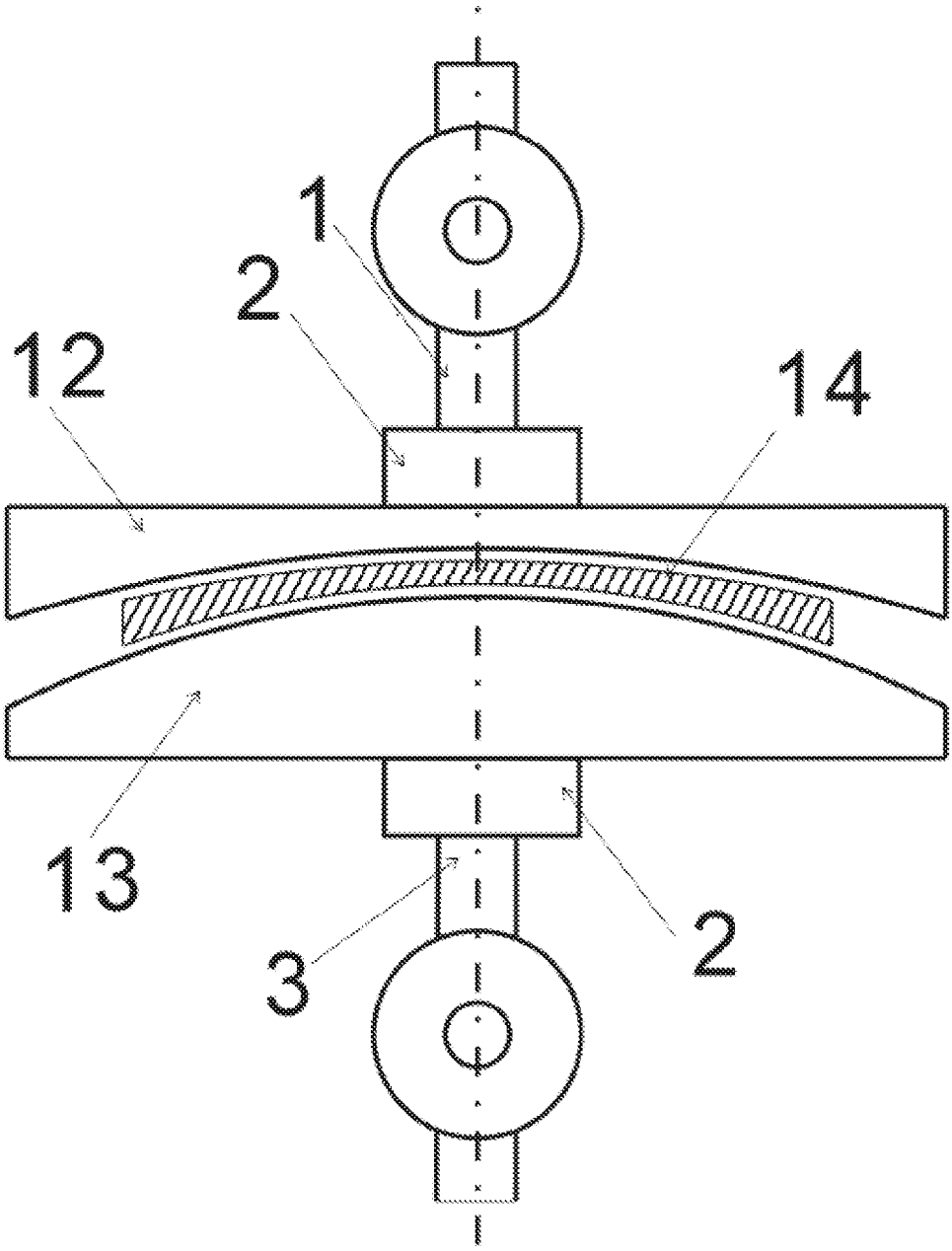
FIG. 4 is a schematic view of a polishing concave convex spherical lens.

As shown in FIG. 4, the concave convex spherical lens 14 is polished by adopting upper and lower abrasive tools 12, 13 of the concave convex spherical lens, and the polishing process is similar to embodiment 1; and the concave convex spherical lens 14 can be also polished by adopting a planar disc abrasive tool 18 and a spherical grinding head abrasive tool 10. When the planar disc abrasive tool 18 and the spherical grinding head abrasive tool 10 are adopted, the concave convex lens 14 to be polished needs to be concentrically mounted in a circular retaining ring 8. The interference fit between the retaining ring 8 and an inner ring of a bearing 9 is conducted, which ensures rotation of the retaining ring 8 and the concave convex lens 14 relative to the inner ring of the bearing 9. The position is adjusted to ensure point contact between the upper and lower surfaces of concave convex spherical lens 14 and the surface of the planar disc abrasive tool 18 and the spherical grinding head abrasive tool 10. Then, by rotating the upper and lower grinding tools 12, 13 of the concave convex spherical lens, the surface material of the lens is continuously removed to achieve the double-sided polishing of the concave convex spherical lens 14.

Figure 7:
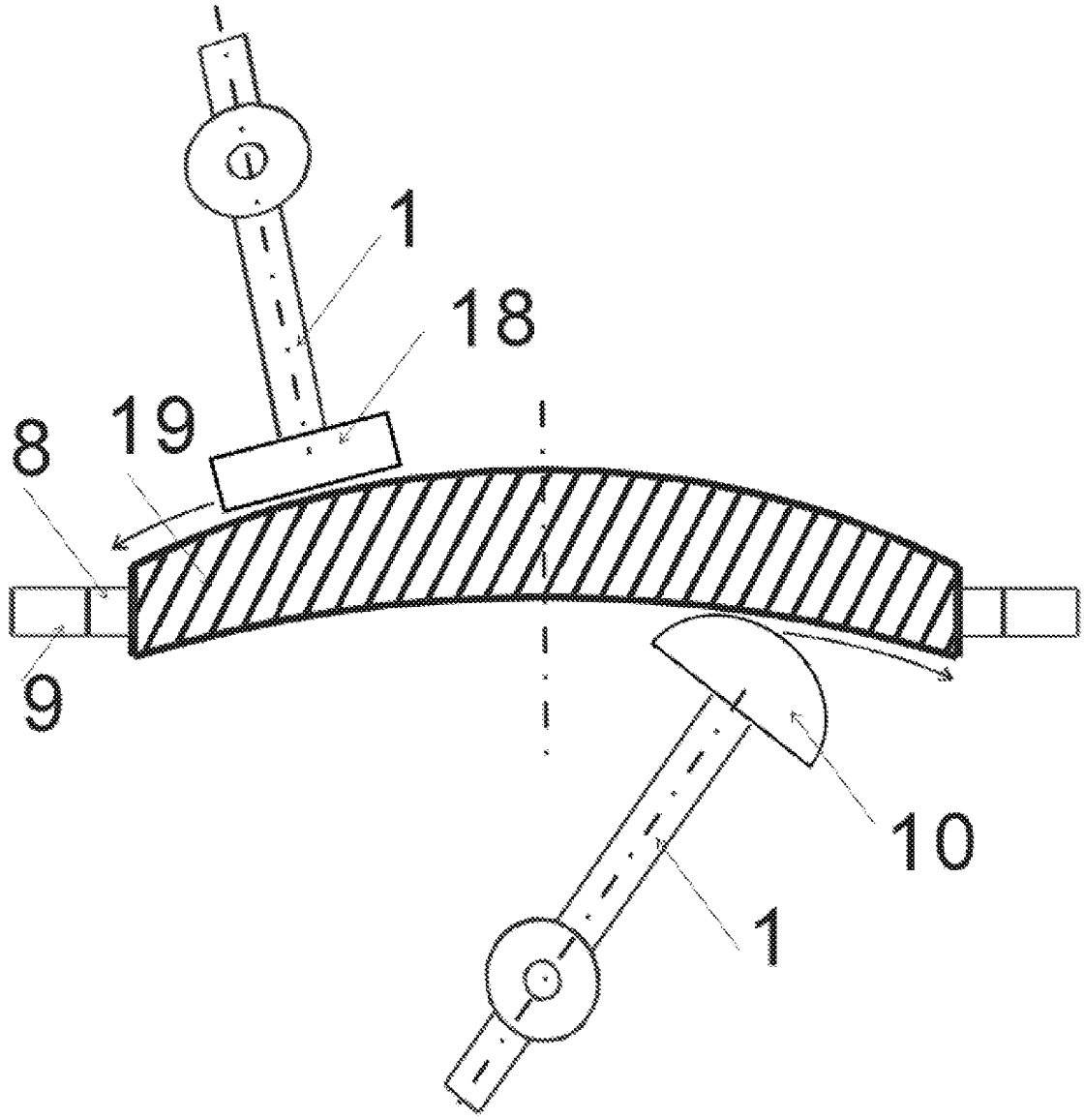
FIG. 7 is a schematic view of a polishing concave convex aspherical lens of small combined abrasive tools.

For the concave convex spherical lens 14, special attention should be paid to the radius of curvature of concave surface larger than that of convex surface when the method is adopted. At the same time, the concave convex spherical lens 14 can also adopt the planar disc abrasive tool 18, the spherical grinding head abrasive tool 10 and the arc disc abrasive tool 7. As shown in FIG. 7, the convex surface of the concave convex aspherical lens 19 is polished by adopting the planar disc abrasive tool 18, and the concave surface is polished by adopting the spherical grinding head abrasive tool 10.

For the double-sided polishing method for the concave convex lens, the detailed steps are described as follows:

step one: the concave convex lens 14 to be polished with radius of curvature of the concave greater than that of the convex is selected. Then, the concave convex lens 14 to be polished is placed in the middle of the upper and lower abrasive tools; and the concave convex lens 14 to be polished needs to be concentrically mounted in a circular retaining ring 8, which ensures rotation of the retaining ring 8 and the concave convex lens 14 relative to the inner ring of the bearing 9.

step two: the position is adjusted to ensure that the upper and lower surfaces of the concave convex lens 14 are connected with the inner surfaces of the upper and lower abrasive tools 12, 13 of the concave convex spherical lens. The contact pressure on the upper and lower abrasive tools 12, 13 of the concave convex lens are adjusted. The contact pressure is kept constant in the process of swing machining, and the whole surface of the lens is polished and swept in a form of surface contact or point contact. In order to ensure a certain material removal rate and uniformity in the process of point contact machining, an angle between an axis of the abrasive tool and a tangent line of a contact point of the lens is 25° in the process of machining;

step three: the rotational speed of the upper abrasive tool of the concave convex lens is set as 8 rpm, and the rotational speed of the lower abrasive tool of the concave convex lens is set as 30 rpm. The upper and lower rods of pendulum 1, 3 drive the upper and lower abrasive tools of the biconcave lens to swing in an opposite direction through the universal joints 2. The polishing time is usually set as 5 min, and at the same time, the upper and lower surfaces of the concave convex lens 14 are polished;

step four: in the polishing process, the rate of material removal in a middle part of the lens is lower than that in the edge of the lens, and the upper and lower rods of pendulum 1, 3 drive the upper and lower abrasive tools 12, 13 of the concave convex spherical lens to swing, which can increase material removal uniformity; and in order to reduce the material removal ununiformity of the upper and lower surfaces of the concave convex lens 14 caused by different rotational speeds of the upper and lower abrasive tools 12, 13 of the concave convex spherical lens, the rotational speeds of the upper and lower abrasive tools 12, 13 of the concave convex spherical lens are adjusted reversely. The rotational speed of the upper abrasive tool 12 of the concave convex spherical lens is set as 30 rpm, and the rotational speed of the lower abrasive tool 13 of the concave convex spherical lens is set as 8 rpm. The polishing time is set as 5 min, and the material removal uniformity of the upper and lower surfaces of the concave convex lens 14 is improved; and step five: the above-mentioned process is carried out until the polishing process is completed.

Embodiment 3

Figure 5:
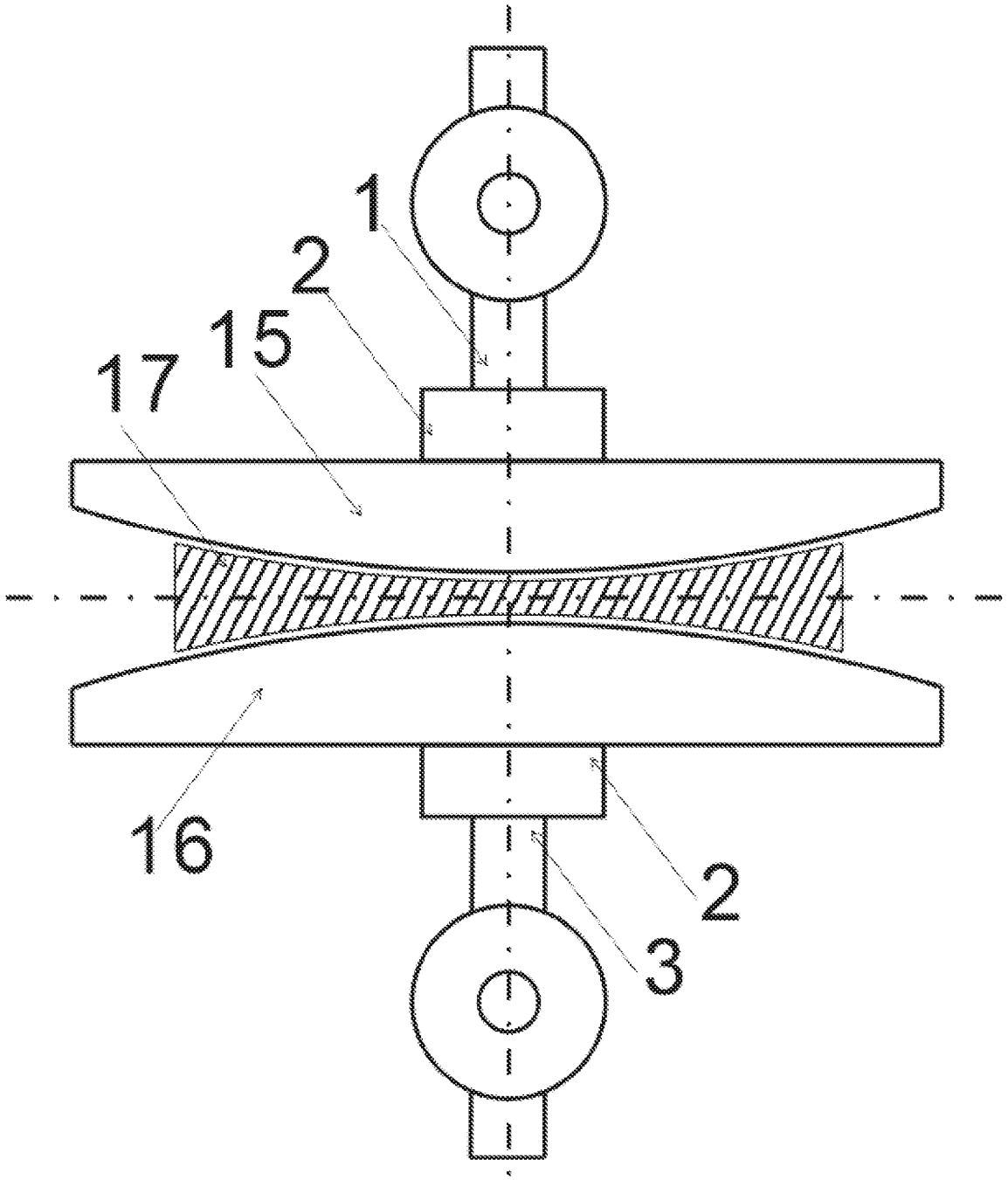
FIG. 5 is a schematic view of a polishing biconcave spherical lens.
Figure 8:
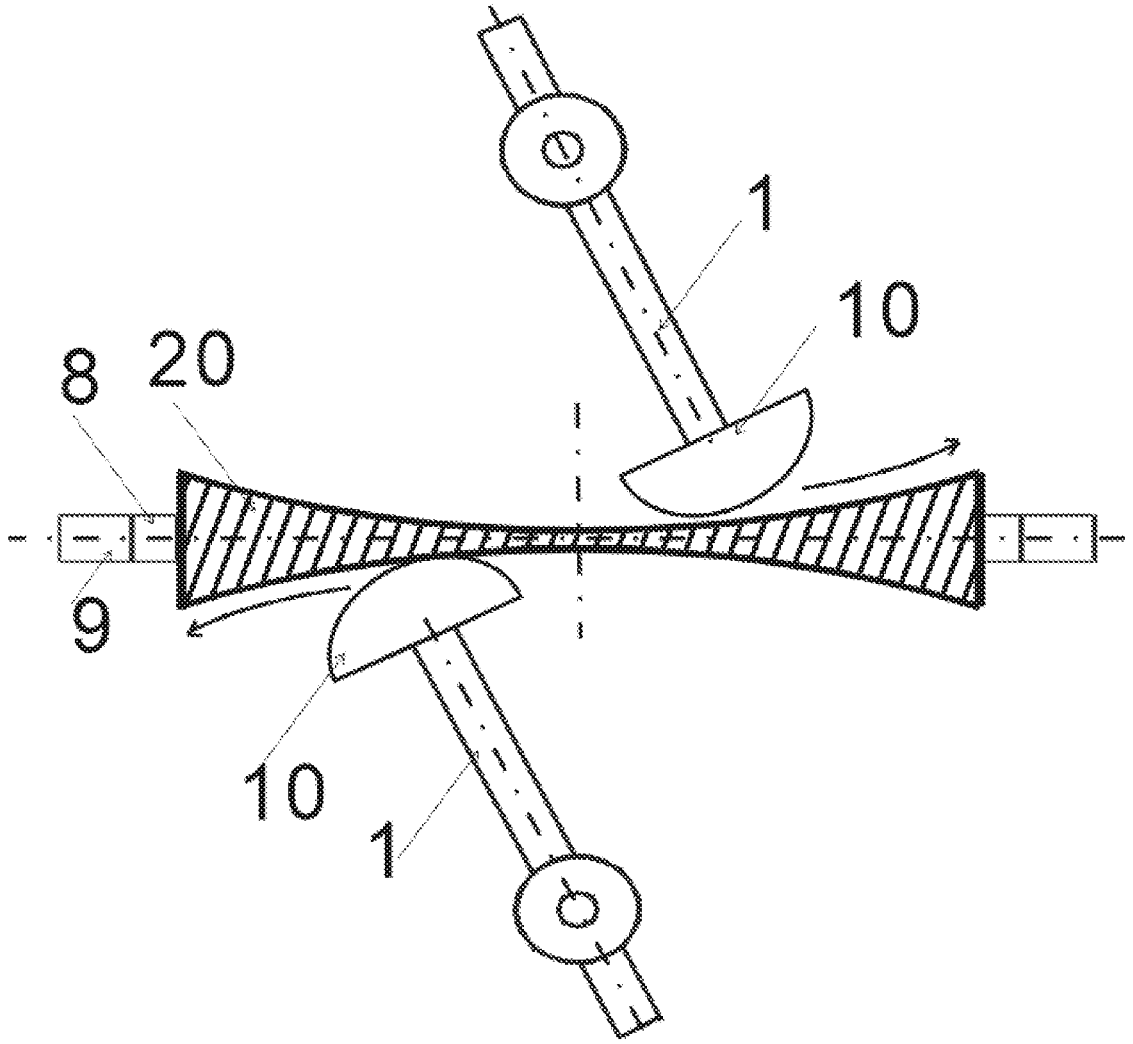
FIG. 8 is a schematic view of a polishing biconcave aspherical lens of small combined abrasive tools.

As shown in FIG. 5, the biconcave spherical lens 17 can be polished by adopting upper and lower abrasive tools 15, 16 of the biconcave spherical lens 18, and the polishing process is similar to embodiment 1; and as shown in FIG. 8, for the biconcave spherical lens 17, a biconcave aspherical lens 20 can also be polished in combination of upper and lower spherical grinding head abrasive tools 10. When the upper and lower spherical grinding head abrasive tools 10 are adopted, the biconcave aspherical lens 20 needs to be concentrically mounted in a circular retaining ring 8. The interference fit between the retaining ring 8 and an inner ring of a bearing 9 is conducted, which ensures rotation of the retaining ring 8 and the biconcave aspherical lens 20 relative to the inner ring of the bearing 9. The position is adjusted to ensure point contact between the upper and lower surfaces of the biconcave aspherical lens 20 and the surfaces of upper and lower spherical grinding head abrasive tools 10. Then, by rotating the surfaces of upper and lower spherical grinding head abrasive tools 10, the surface material of the lens is continuously removed to achieve the double-sided polishing of the biconcave aspherical lens 20.

For the double-sided polishing method for the biconcave lens, the detailed steps are described as follows:

step one: a biconcave aspherical lens 20 to be polished with radius of curvature is selected, and the biconcave aspherical lens 20 to be polished is placed in the middle of the upper and lower abrasive tools; and the biconcave aspherical lens 20 needs to be concentrically mounted in a circular retaining ring 8, which ensures rotation of the retaining ring 8 and the biconcave aspherical lens 20 relative to the inner ring of the bearing 9;

step two: the position is adjusted to ensure that the upper and lower surfaces of the biconcave aspherical lens 20 are connected with the upper and lower spherical grinding head abrasive tools 10. The contact pressure on the upper and lower spherical grinding head abrasive tools 10 of the biconcave convex are adjusted. The contact pressure is kept constant in the process of swing machining, and the whole surface of the lens is polished and swept in a form of surface contact or point contact. In order to ensure a certain material removal rate and uniformity in the process of point contact machining, an angle between an axis of the abrasive tool and a tangent line of a contact point of the lens is 25° in the process of machining;

step three: the rotational speed of the upper and lower spherical grinding head abrasive tools 10 is set as 25° rpm, and the rotational speed of the lens is set as 65 rpm. The upper and lower rods of pendulum 1, 3 drive the upper and lower spherical grinding head abrasive tools 10 to swing in an opposite direction through the universal joints 2. The polishing time is usually set as 5 min, and at the same time, the upper and lower surfaces of the biconcave aspherical lens 20 are polished;

step four: in the polishing process, the sweeping time of a middle part and an outer circle part of the surface spherical grinding head abrasive tools 10 of the lens is basically the same. The rate of material removal in a middle part of the lens is higher than that in the edge of the lens, and the upper and lower rods of pendulum 1, 3 drive the upper and lower spherical grinding head abrasive tools 10 to swing, which can increase material removal uniformity. The polishing uniformity can be increased by reducing the sweeping time of the spherical grinding head abrasive tool 10 in the middle position. Generally, the sweeping time of the spherical grinding head abrasive tool 10 is reduced within ⅕ of lens aperture.

step five: the above-mentioned process is carried out until the polishing process is completed.

The above embodiments only express the implementation of the present invention, and shall not be interpreted as a limitation to the scope of the patent for the present invention. It should be noted that, for those skilled in the art, several variations and improvements can also be made without departing from the concept of the present invention, all of which belong to the protection scope of the present invention.

The invention claimed is:

1. A double-sided polishing method for an optical lens, wherein in the double-side polishing method, upper and lower surfaces of the lens are thus polished simultaneously by arranging abrasive tools on upper and lower positions of the lens, wherein the optical lens is chosen from a group of optical lenses consisting of: a biconvex lens, a biconcave lens, and a concave convex lens, specifically comprising the following steps:

step one: placing the lens to be polished in the middle of the upper and lower abrasive tools, each respectively connected with a motor; and connecting the upper and lower abrasive tools with universal joints and connecting the universal joints with rods of pendulum;

step two: adjusting the upper and lower positions of the lens in order to ensure that the upper and lower surfaces of the lens are bonded to or in point contact with inner surfaces of the upper and lower abrasive tools, adjusting a loading pressure on the upper and lower abrasive tools of the lens, and pressing the lens between the upper and lower abrasive tools;

step three: setting a certain speed of the upper and lower abrasive tools of the lens, and at the same time, polishing the upper and lower surfaces of the lens, wherein the motion of the abrasive tools in the polishing process comprises axial rotation of the upper and lower abrasive tools each about an axis of the rods of pendulum, and an overall side-to-side reciprocating swing of the upper and lower abrasive tools through the universal joints, wherein the axial rotation of the upper and lower abrasive tools is driven by the motor, and upper and lower rods of pendulum drive the upper and lower abrasive tools to swing in an opposite direction through the universal joints, and the upper and lower rods of pendulum drive the upper and lower abrasive tools to swing, which can increase material removal uniformity; and in addition, during the polishing process, a polishing fluid is supplied in a manner of center-inlet supply or external drip of the abrasive tools; and step four: turning over and machining the lens, or adjusting the rotational speeds of the upper and lower abrasive tools under the condition of the same radius of curvature of the upper and lower surfaces, to complete a polishing process.

2. The double-sided polishing method for the optical lens according to claim 1, wherein the optical lenses can be divided into groups of either a spherical lens or an aspherical lens, according to the characteristics of surface curvature of the optical lens, wherein the aspherical lens group of the optical lenses can only be polished by using a spherical grinding head abrasive tool and a planar disc abrasive tool; and according to the characteristics of the surface shape, the spherical lens group of the optical lenses can be polished by using an arc disc abrasive tool, the spherical grinding head abrasive tool and the planar disc abrasive tool and upper and lower covering type abrasive tools respectively.

3. The double-sided polishing method for the optical lens according to claim 1, wherein the chosen optical lens from the group is a biconvex lens, and the double-sided polishing method for the biconvex lens comprises the following steps:

step one further comprises: placing the biconvex spherical lens to be polished in the middle of the upper and lower abrasive tools for the biconvex spherical lens;

step two further comprises: adjusting the position to ensure that the upper and lower surfaces of the biconvex spherical lens are bonded to the inner surfaces of the two abrasive tools for the biconvex spherical lens, adjusting the loading pressure on the upper and lower abrasive tools for the biconvex spherical lens, pressing the biconvex spherical lens between the upper and lower abrasive tools, and setting the distance between a center of the upper and lower abrasive tools and a center of the lens as ⅓ of an aperture of the lens in the process of swing machining;

step three further comprises: setting the rotational speed of the upper abrasive tool for the biconvex spherical lens as 8 rpm and the rotational speed of the lower abrasive tool for the biconvex spherical lens as 30 rpm, making the upper and lower rods of pendulum drive the upper and lower abrasive tools of the biconvex spherical lens to swing in an opposite direction through the universal joints, and setting the polishing time as 5 min, and at the same time, polishing the upper and lower surfaces of the biconvex spherical lens; and step four further comprises: in order to increase the material removal uniformity of the upper and lower surfaces of the biconvex spherical lens caused by different rotational speeds of the upper and lower abrasive tools for the biconvex spherical lens, under the condition of the same radius of curvature of the upper and lower surfaces, turning over and machining the biconvex spherical lens to achieve uniformity requirements; and in addition, reversely adjusting the rotational speeds of the upper and lower abrasive tools of the biconvex spherical lens.

4. The double-sided polishing method for the optical lens according to claim 1, wherein the chosen optical lens of the group is a concave convex lens, and the double-sided polishing method for the concave convex lens comprises the following steps:

step one further comprises: firstly, concentrically mounting the concave convex lens to be polished with radius of curvature of the concave greater than that of the convex in a circular retaining ring 8, and conducting an interference fit between an outer ring of the retaining ring and an inner ring of a bearing, to ensure rotation of the retaining ring and the concave convex lens relative to the inner ring of the bearing; and then, placing the concave convex lens to be polished in the middle of the upper and lower abrasive tools;

step two further comprises: adjusting the position to ensure that the upper and lower surfaces of the concave convex lens are connected with or in point contact with the inner surfaces of the upper and lower abrasive tools, adjusting a contact pressure on the upper and lower abrasive tools for the concave convex lens, keeping the contact pressure constant in the process of swing machining, and polishing and sweeping the whole surface of the lens in forms of surface contact or point contact, wherein, in order to ensure a certain material removal rate and uniformity in the process of point contact machining, an angle between an axis of the upper and lower abrasive tools and a tangent line of a contact point of the lens is 25° in the process of machining;

step three further comprises: setting the rotational speed of the upper abrasive tool as 8 rpm and the rotational speed of the lower abrasive tool as 30 rpm, making the upper and lower rods of pendulum drive the upper and lower abrasive tools of the biconcave lens to swing in an opposite direction through the universal joints, setting the polishing time as 5 min, and at the same time, polishing the upper and lower surfaces of the concave convex lens; and step four further comprises: reversely adjusting the rotational speeds of the upper and lower abrasive tools for the concave convex spherical lens.

5. The double-sided polishing method for the optical lens according to claim 1, wherein the chosen optical lens of the group is a biconcave lens, and the double-sided polishing method for the biconcave lens comprises the following steps:

step one further comprises: concentrically mounting the biconcave lens to be polished in a circular retaining ring, and conducting an interference fit between an outer ring of the retaining ring and an inner ring of a bearing, to ensure rotation of the retaining ring and the biconcave lens relative to the inner ring of the bearing; and then, placing the biconcave lens to be polished in the middle of the upper and lower abrasive tools;

step two further comprises: adjusting the position to ensure that the upper and lower surfaces of the biconcave lens are bonded to the inner surfaces of the upper and lower abrasive tools, adjusting a contact pressure on the upper and lower abrasive tools for the biconcave lens, keeping the contact pressure constant in the process of swing machining, and sweeping and polishing the whole surface of the lens in a form of surface contact or point contact, wherein, in order to ensure a certain material removal rate and uniformity in the process of point contact machining, an angle between an axis of the abrasive tool and a tangent line of a contact point of the lens is 25° in the process of machining;

step three further comprises: setting the rotational speed of the upper abrasive tool as 8 rpm and the rotational speed of the lower abrasive tool as 30 rpm, making the upper and lower rods of pendulum drive the upper and lower abrasive tools for the biconcave lens, to swing in opposite directions through the universal joints, setting polishing time as 5 min, and at the same time, polishing the upper and lower surfaces of the biconcave lens; and step four further comprises: under condition of a same radius of curvature of the upper and lower surfaces, turning over and machining the biconcave lens, wherein when the number of times of turning over and machining reaches more than 6, the upper and lower surface can achieve uniformity requirements.

* * * * *